US011180349B2

(12) United States Patent
Mitani

(10) Patent No.: US 11,180,349 B2
(45) Date of Patent: Nov. 23, 2021

(54) CRANE VEHICLE

(71) Applicant: TADANO LTD., Kagawa (JP)

(72) Inventor: Kazuo Mitani, Kagawa (JP)

(73) Assignee: TADANO LTD., Kagawa (JP)

( * ) Notice: Subject to any disclaimer, the term of this patent is extended or adjusted under 35 U.S.C. 154(b) by 76 days.

(21) Appl. No.: 16/631,311

(22) PCT Filed: Jul. 18, 2018

(86) PCT No.: PCT/JP2018/026990
§ 371 (c)(1),
(2) Date: Jan. 15, 2020

(87) PCT Pub. No.: WO2019/017409
PCT Pub. Date: Jan. 24, 2019

(65) Prior Publication Data

US 2020/0207590 A1 Jul. 2, 2020

(30) Foreign Application Priority Data

Jul. 18, 2017 (JP) ..... JP2017-138865

(51) Int. Cl.
*B66C 13/23* (2006.01)
*B66D 1/48* (2006.01)
*B66C 23/42* (2006.01)

(52) U.S. Cl.
CPC ..... *B66C 13/23* (2013.01); *B66C 23/42* (2013.01); *B66D 1/485* (2013.01); *B66C 2700/0371* (2013.01)

(58) Field of Classification Search
CPC ..... B66C 13/04; B66C 13/16; B66C 13/18; B66C 13/88; B66C 13/23; B66D 1/485
See application file for complete search history.

(56) References Cited

U.S. PATENT DOCUMENTS

2017/0008739 A1* 1/2017 Nguyen ..... B66C 1/108
2018/0111803 A1* 4/2018 Yamaura ..... B66C 23/701
2019/0300339 A1* 10/2019 Kawai ..... B66C 13/22

FOREIGN PATENT DOCUMENTS

JP 3255461 B2 2/2002
JP 2016-023054 A 2/2016

OTHER PUBLICATIONS

Oct. 16, 2018, International Search Report issued for related PCT Application No. PCT/JP2018/026990.

(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

A crane vehicle includes: an operation unit; a winch device configured to operate at a speed corresponding to an operation amount of the operation unit; a weight detection unit; a storage unit configured to store a time-weight target characteristic indicating a target in temporal change of a detected value at the weight detection unit for a maximum operation amount input from the operation unit; and a control unit configured to perform feedback control of an operation speed of the winch device such that the detected value follows the time-weight target characteristic in a case where the maximum operation amount is input from the operation unit, the control unit being configured to set the operation speed of the winch device at the speed corresponding to the operation amount of the operation unit, in a case where fluctuation of the detected value has converged in a predetermined range.

4 Claims, 8 Drawing Sheets

(56) References Cited

OTHER PUBLICATIONS

Oct. 16, 2018, International Search Opinion issued for related PCT Application No. PCT/JP2018/026990.

* cited by examiner

CRANE VEHICLE

CROSS REFERENCE TO PRIOR APPLICATION

This application is a National Stage Patent Application of PCT International Patent Application No. PCT/JP2018/026990 (filed on Jul. 18, 2018) under 35 U.S.C. § 371, which claims priority to Japanese Patent Application No. 2017-138865 (filed on Jul. 18, 2017), which are all hereby incorporated by reference in their entirety.

TECHNICAL FIELD

The present invention relates to a technology of a crane vehicle including a winch device to be automatically controlled to an optimum winch operation, regardless of a full-lever operation made at start-up.

BACKGROUND ART

A telescopic boom, a swivel, a lower frame, and an outrigger included in a crane vehicle, such as a rough terrain crane or an all terrain crane, each are a welded structure made of mainly steel having elasticity. Thus, the telescopic boom, the swivel, the lower frame, and the outrigger elastically deform large due to the load of a lifting load.

In addition, a wire rope for lifting up the lifting load is formed of twisted high-strength steel strands. Thus, the wire rope extends large due to the load of the lifting load.

Therefore, on the occasion of a winch operation, an expert operator determines an optimum winch operation amount (winch speed) while sensing what degree of weight has been currently loaded to the crane vehicle, from crane behavior based on the degree of warp of the structures of the crane vehicle and the degree of extension of the wire rope that occur at winch start-up.

In recent years, an electric operation system has been adopted as an operation system for a crane vehicle.

The electric operation system includes a winch operation means, a control means, and an actuator means. The winch operation means electrically detects the operation direction and the operation amount of an actuator. The control means receives an electric signal from the winch operation means, and then generates an operation-direction command signal and an operation-speed command signal for the actuator. The actuator means receives the command signals from the control means, and then drives the actuator at the commanded speed in the commanded direction.

In the electric operation system, the crane operation information described above is once converted into an electric signal completely. On the basis of such an electric signal, the control means controls the crane vehicle, so that advanced crane control that has not been achieved conventionally, can be achieved.

A control device of a hydraulic-driven winch described in Patent Literature 1 has been proposed as winch control of a crane vehicle. The control device of the hydraulic-driven winch described in Patent Literature 1, performs control as follows.

Operating the operation lever of the winch, causes the winch to start up. Then, the control device performs winding-up at a very slow speed, regardless of the operation amount of the operation lever. In a case where the load of a lifting load detected by a load detector has no fluctuation, the control device determines that lifting of the lifting load off the ground has been completed.

After that, the control device gradually increases the winding-up speed of the hydraulic-driven winch to a winding-up speed appropriate to the operation amount of the operation lever.

Such a control device automatically performs winging-up at a constant very slow speed until the completion of lifting of the lifting load off the ground, regardless of a full-lever operation made at start-up. Therefore, secure lifting off the ground is performed with the crane vehicle prevented from being applied with impact weight.

A winch actuator described in Patent Literature 2 has been proposed as winch control of a crane vehicle.

The winch actuator described in Patent Literature 2 temporally calculates actual weight applying to the leading end of a boom, and controls the high-speed/low-speed switch driving of a winch motor, on the basis of the result of comparison between the actual weight and a threshold.

Such a winch actuator can drive the winch motor at either high speed or low speed, in a winch winding-up operation.

CITATION LIST

Patent Literature

Patent Literature 1: JP 3255461 B2
Patent Literature 2: JP 2016-23054 A

SUMMARY OF THE INVENTION

Problems to be Solved by the Invention

Meanwhile, the control device of the hydraulic-driven winch described in Patent Literature 1, performs winding-up at the constant very slow speed until completion of lifting off the ground. Therefore, in some cases, the completion of lifting off the ground takes a long time.

That is, in a lifting position with a base boom, with the number of wire ropes that is one and the protruding width of an outrigger that is minimum, the amount of elastic deformation of the structures of the crane and the wire rope becomes minimum. Thus, lifting of the lifting load off the ground is completed in a short time. Therefore, the weight of the lifting load is applied to the crane vehicle, sharply.

Because of the reason, the control device described in Patent Literature 1 sets the winch speed at start-up, at a very slow speed sufficient to cause no impact weight, even under the condition that the elastic deformation becomes minimum as described above.

Meanwhile, in a lifting position with a telescopic boom having extended entirely, with the number of wire ropes that is at least two and the protruding width of the outrigger that is maximum, the structures of the crane deform large and the wire rope extends large. Thus, the length of the wire rope that the winch winds up until lifting off the ground is considerably large.

Under such a condition, the winch speed at the set very slow speed, takes a considerably long time from winch start-up to lifting of the lifting load off the ground.

The winch actuator described in Patent Literature 2 switches the speed of the winch motor to either the high speed or the slow speed. However, such a switch of the speed of the winch motor is not performed in a case where a full-lever operation is made.

An object of the present invention is to provide a crane vehicle including a winch device applied with a recent advanced electric operation system, in which the winch device is automatically controlled to an appropriate winch operation, regardless of a full-lever operation made at winch start-up.

Solutions to Problems

A crane vehicle according to the present invention includes: an operation unit; a winch device configured to operate at a speed corresponding to an operation amount of the operation unit, to wind up and feed out a wire rope to which a hook is fixed; a weight detection unit configured to detect a weight of a lifting load; a storage unit configured to store a time-weight target characteristic indicating a target in temporal change of a detected value at the weight detection unit for a maximum operation amount input from the operation unit; and a control unit configured to perform feedback control of an operation speed of the winch device such that the detected value follows the time-weight target characteristic in a case where the maximum operation amount is input from the operation unit, the control unit being configured to set the operation speed of the winch device at the speed corresponding to the operation amount of the operation unit, in a case where fluctuation of the detected value has converged in a predetermined range.

Effects of the Invention

According to the present invention, because automatic control is performed for an appropriate winch operation, regardless of a full-lever operation made at start-up, winch work can be securely performed with the crane vehicle prevented from being damaged.

DESCRIPTION OF EMBODIMENTS

A crane vehicle 1 according to an embodiment of the present invention will be described with reference to FIG. 1.

Figure 1:
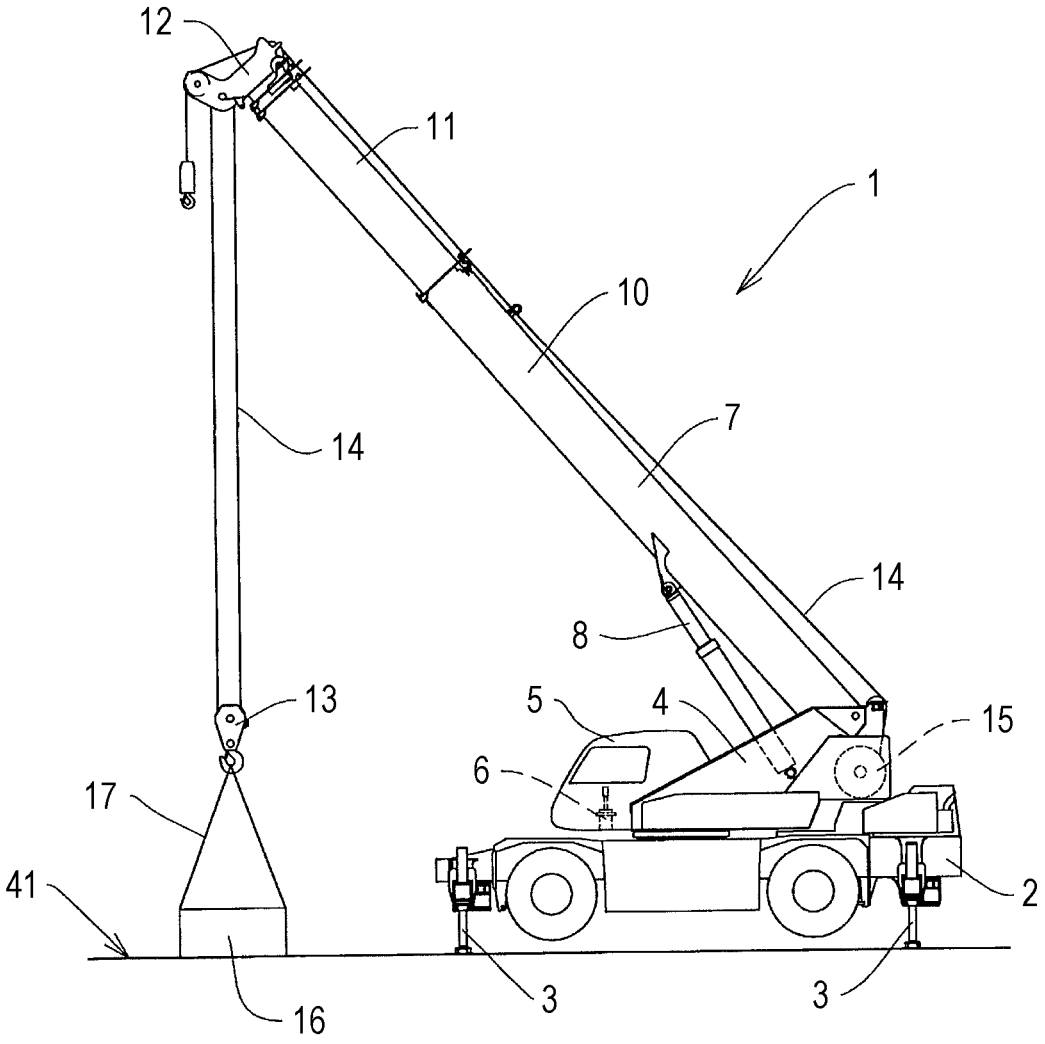
FIG. 1 is a view of a crane vehicle according to an embodiment of the present invention.

The crane vehicle 1 illustrated in FIG. 1 is in the outrigger protruding state where an outrigger 3 provided ahead of and behind a lower frame 2 is extended. A swivel frame 4 is mounted on the lower frame 2 so as to swivel flexibly. A cab 5 is disposed at the swivel frame 4. A crane operation means including a winch operation means 6 is disposed inside the cab 5.

The crane vehicle 1 maintains a crane work position in which a telescopic boom 7 is raised upward by an angle of approximately 45 degrees with a derricking cylinder 8. The length of the telescopic boom 7 results from an extension of approximately 50% of a second boom 11 to a base boom 10.

A hook 13 is hung from the leading end of a top boom 12 through a wire rope 14. The wire rope 14 is slung around between the top boom 12 and the hook 13 by multiple slinging. The wire rope 14 is fed out from a winch drum 15 disposed at the swivel frame 4.

Note that, the hook 13, the wire rope 14, and the winch drum 15 illustrated in FIG. 1 belong to a main winch. Needless to say, the present invention can be applied to a hook, a wire rope, and a drum belonging to a sub-winch.

A lifting load 16 placed on the ground is set with a sling wire rope 17, so that the lifting load 16 can be lifted up with the hook 13.

Figure 2:
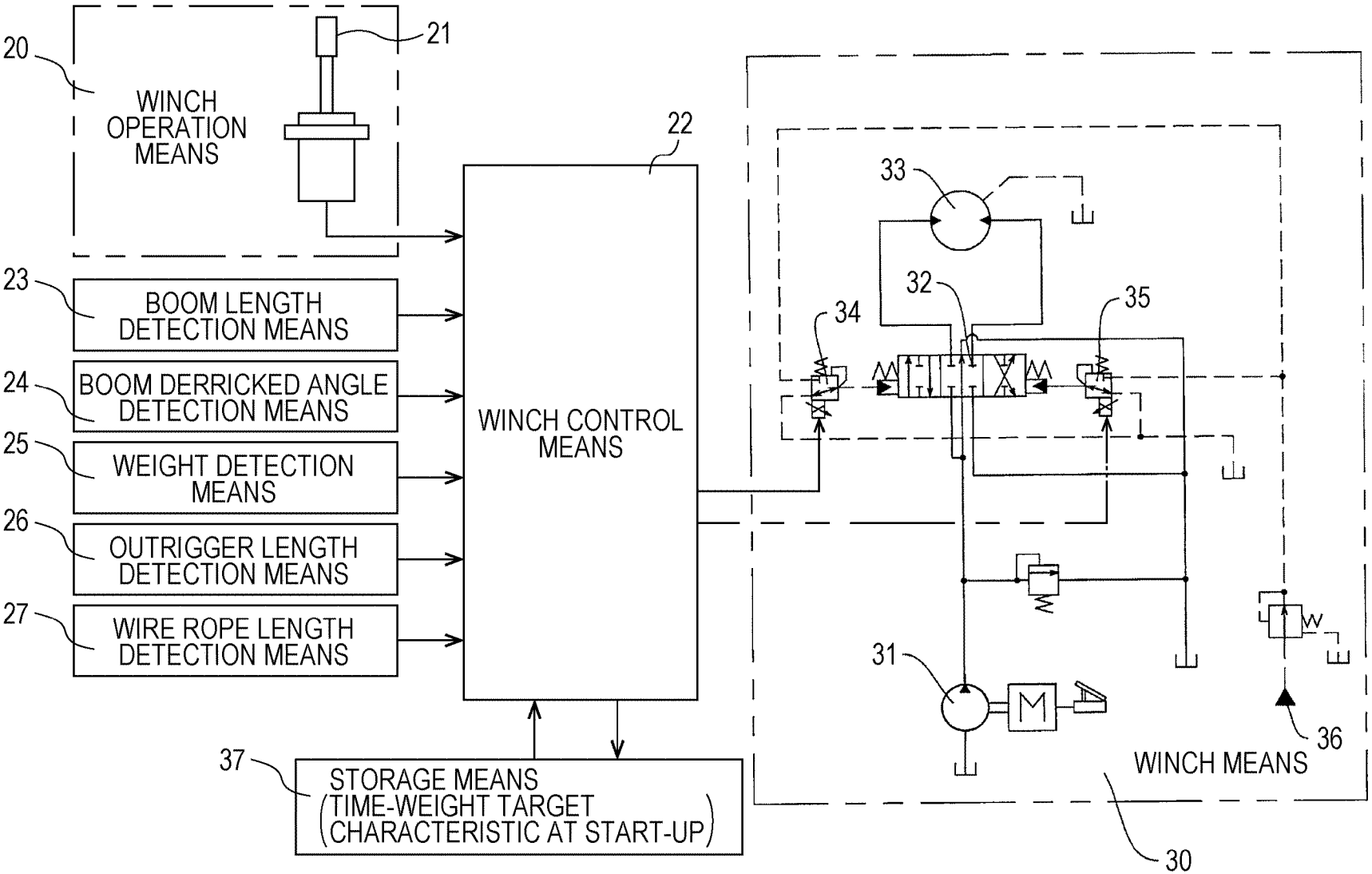
FIG. 2 is a block diagram of control of the crane vehicle according to the embodiment.

Control of a winch device of the crane vehicle 1 according to the embodiment of the present invention, will be described with reference to a block diagram in FIG. 2 (refer to FIG. 1 for the structure of the crane vehicle 1).

A winch operation means 20 detects the operation direction and the operation amount of a winch lever 21 (also referred to as an operation unit). The winch operation means 20 generates a winch operation signal, on the basis of a detected value, and then outputs the winch operation signal to a winch control means 22 (also referred to as a control unit).

A boom length detection means 23 detects the boom length of the telescopic boom 7. The boom length detection means 23 generates a boom length signal, on the basis of a detected value, and then outputs the boom length signal to the winch control means 22.

A boom derricked angle detection means 24 detects the derricked angle of the telescopic boom 7. The boom derricked angle detection means 24 generates a boom derricked angle signal, on the basis of a detected value, and then outputs the boom derricked angle signal to the winch control means 22.

A weight detection means 25 (also referred to as a weight detection unit) detects the weight of the lifting load 16 hung with the wire rope 14 fed out from the winch drum 15. The weight detection means 25 generates a detected-weight signal, on the basis of a detected value, and then outputs the detected-weight signal to the winch control means 22.

An outrigger length detection means 26 detects the outrigger slid length of the outrigger 3. The outrigger length detection means 26 generates an outrigger length signal, on the basis of a detected value, and then outputs the outrigger length signal to the winch control means 22. A wire rope length detection means 27 detects the length of the wire rope 14 fed out from the winch device.

The winch control means 22 receives the winch operation signal and the detected-weight signal, and then generates a winch-drum rotation-direction command signal and a winch-drum rotation-speed command signal.

A winch means 30 receives a command signal (specifically, the winch-drum rotation-direction command signal and the winch-drum rotation-speed command signal) from the winch control means 22, and drives the winch drum 15 at the commanded speed in the commanded direction.

The winch means 30 includes a hydraulic pump 31, a pilot switching valve 32, a hydraulic motor 33, a proportional solenoid valve 34, and a proportional solenoid valve 35.

The proportional solenoid valve 34 and the proportional solenoid valve 35 each receive pilot pressure from a pilot pressure source 36. The proportional solenoid valve 34 and the proportional solenoid valve 35 each apply switching pressure generated in proportion to the command signal from the winch control means 22, to the pilot switching valve 32.

The pilot switching valve 32 receives operating oil from the hydraulic pump 31. The pilot switching valve 32 supplies an amount of operating oil corresponding to the amount of switching, to the hydraulic motor 33.

The winch means 30 is provided with a pressure compensation circuit (not illustrated) for the operating pressure of the hydraulic motor 33. Thus, regardless of the operating pressure of the hydraulic motor 33, a rotation speed of the hydraulic motor 33, proportional to the degree of opening of the pilot switching valve 32, is acquired. That is, regardless of the weight of the lifting load 16, a winch speed proportional to the winch-drum rotation-speed command signal output from the winch control means 22 is acquired.

A storage means 37 (also referred to as a storage unit) stores a time-weight target characteristic at winch start-up. The time-weight target characteristic indicates the target value in temporal change of the detected value at the weight detection means 25 for the maximum operation amount input from the winch lever 21. Such a time-weight target characteristic is stored in the storage means 37, in which weight is associated with time. FIG. 4C illustrates an exemplary time-weight target characteristic in a graph.

Here, the "time-weight target characteristic at start-up" will be described. When the winch lever 21 is operated at time T1, the winch drum 15 starts to rotate (in other words, the winch drum 15 starts up), so that the wire rope 14 starts to be wound up (or to be fed out). However, as described in Background Art, because the steel structures of the crane vehicle 1 or the wire rope 14 is elastic, the weight value that the weight detection means 25 detects does not change linearly. Along with the elapse of time t from time T1 that is the winch start-up, the weight value W changes while following the change of extension of the wire rope 14 and warp of the steel structures.

The relationship between time t and detected weight W (to be targeted) based on expert operator's many years of experience is set as the "time-weight target characteristic at start-up". That is the detected weight W to be targeted as a function of time t is set as "target weight". In other words, in a case where a maximum operation amount of operation input is made from the winch lever 21 with the winch device inactive (namely, in a case where a full-lever operation is made to the winch lever 21), the target weight indicates the target value to the detected value at the weight detection means 25 during the elapse of time t after the operation input (namely, the start-up of the winch device).

The time-weight target characteristic at start-up may include one characteristic or may include a plurality of characteristics. For example, the time-weight target characteristic at start-up may include a plurality of characteristics each including at least one of boom length, boom derricked angle, outrigger slid length, and wire rope length as a parameter.

Specifically, for a work status (e.g., the work of lifting off the ground), the storage means 37 may store the time-weight target characteristic corresponding to any one parameter of the boom length, the boom derricked angle, the outrigger slid length, and the wire rope length at the point in time when a maximum operation amount of operation input is made from the winch lever 21.

When receiving the winch operation signal of the maximum operation amount at winch start-up, the winch control means 22 reads the time-weight target characteristic at start-up, from the storage means 37. In a case where the time-weight target characteristic includes a plurality of characteristics, the characteristic may be read, corresponding to at least one parameter of the boom length, the boom derricked angle, the outrigger slid length, and the wire rope length at winch start-up.

The winch control means 22 performs feedback control based on the detected-weight signal of the weight detection means 25 such that the detected-weight signal changes along (namely, following) the time-weight target characteristic at start-up. The winch control means 22 outputs the winch-drum rotation-speed command signal generated by the feedback control, to the winch means 30.

The configuration of a feedback control system of the winch device of the crane vehicle 1 according to the embodiment of the present invention will be described with reference to FIG. 3.

At winch start-up, in a case where the winch operation signal of the maximum operation amount from the winch lever 21 is input to the winch control means 22, the winch control means 22 reads the time-weight target characteristic at start-up, from the storage means 37. The winch control means 22 reads the time-weight target characteristic corresponding to the work status of the crane vehicle 1 (e.g., at lifting off the ground), from storage means 37.

An exemplary time-weight target characteristic at start-up will be given with reference to FIG. 4C. A solid line 40 indicating the relationship between time t and lifting-load weight W, expresses the time-weight target characteristic at start-up at lifting off the ground.

The time-weight target characteristic at start-up at lifting off the ground is set such that the target weight increases from zero at a predetermined change rate.

Figure 3:
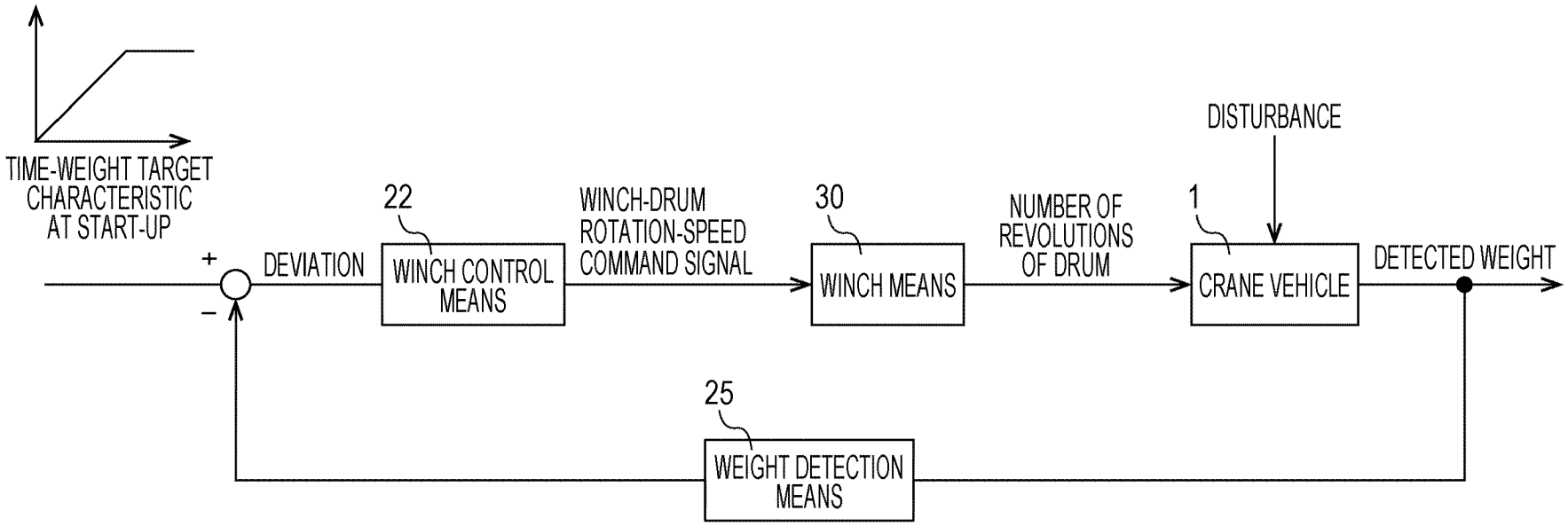
FIG. 3 is a diagram of the configuration of a feedback control system of the crane vehicle according to the embodiment.

As illustrated in FIG. 3, the winch control means 22 generates the winch-drum rotation-speed command signal, on the basis of the time-weight target characteristic at start-up, and then outputs the winch-drum rotation-speed command signal, to the winch means 30.

The wire rope 14 is wound up or is fed out in accordance with the number of revolutions of the winch drum of the winch means 30, so that the crane vehicle 1 performs crane work. Disturbance acts on the crane vehicle 1.

The weight detection means 25 detects the weight of the lifting load 16 for feedback.

The winch control means 22 calculates the deviation between the time-weight target characteristic at start-up and the detected weight.

The winch control means 22 generates the winch-drum rotation-speed command signal such that the detected weight comes close to the time-weight target characteristic at start-up, namely, such that the deviation becomes zero. The generated winch-drum rotation-speed command signal is output to the winch means 30.

Then, the feedback control in the configuration of the feedback control system of the winch device illustrated in FIG. 3 is repeated.

<Operation at Lifting Off the Ground>

The operation at lifting off the ground of the winch device of the crane vehicle 1 according to the embodiment will be described in accordance with a flowchart illustrated in FIG. 5.

The crane vehicle 1 is in the state where the lifting load 16 is placed on the ground 41 before lifting off the ground (refer to FIG. 1). Here, the operator in the cab 5 makes a full-lever (maximum operation amount) operation to the winch lever 21 of the winch operation means 6 to the winding-up side (refer to FIG. 2).

At STEP 1, the winch operation-direction signal of the winding-up is input.

Figure 4A:
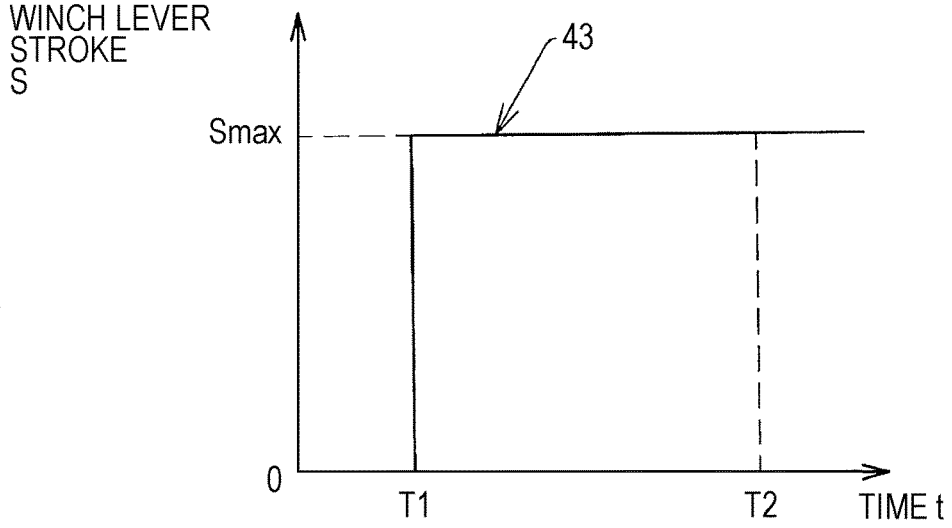
FIGS. 4A, 4B, and 4C are graphs for describing the control at lifting off the ground of the crane vehicle according to the embodiment.

At STEP 2, the winch operation signal of the maximum operation amount is input (at time T1 of FIG. 4A).

At STEP 3, the boom length signal, boom derricked angle signal, outrigger length signal, and wire rope length signal are input.

At STEP 4, the time-weight target characteristic at start-up is read. Specifically, at STEP 4, the winch control means 22 reads, from the storage means 37, the time-weight target characteristic at start-up that corresponds to the state of lifting off the ground and corresponds to each signal input at STEP 3.

At STEP 5, it is determined whether the detected-weight signal has changed to a constant value from its increase. That is, at STEP 5, the winch control means 22 determines whether the fluctuation of the detected value of the weight detection means 25 has converged within a predetermined range.

In a case where it is determined at STEP 5 that the detected-weight signal has not changed to the constant value from its increase (NO at STEP 5), at STEP 6, the winch-drum rotation-speed command signal is output by the feedback control based on the detected-weight signal. Then, at STEP 7, the detected-weight signal is input.

Specifically, as illustrated in FIG. 4A, a winch lever stroke S43 is operated to Smax at time T1. Then, the winch-drum rotation-speed command signal V44 illustrated in FIG. 4B is generated and output along the time-weight target characteristic at start-up, indicated with the solid line 40 of FIG. 4C.

After that, the feedback control in the configuration of the feedback control system, described with FIG. 3 is repeated.

Figure 4B:
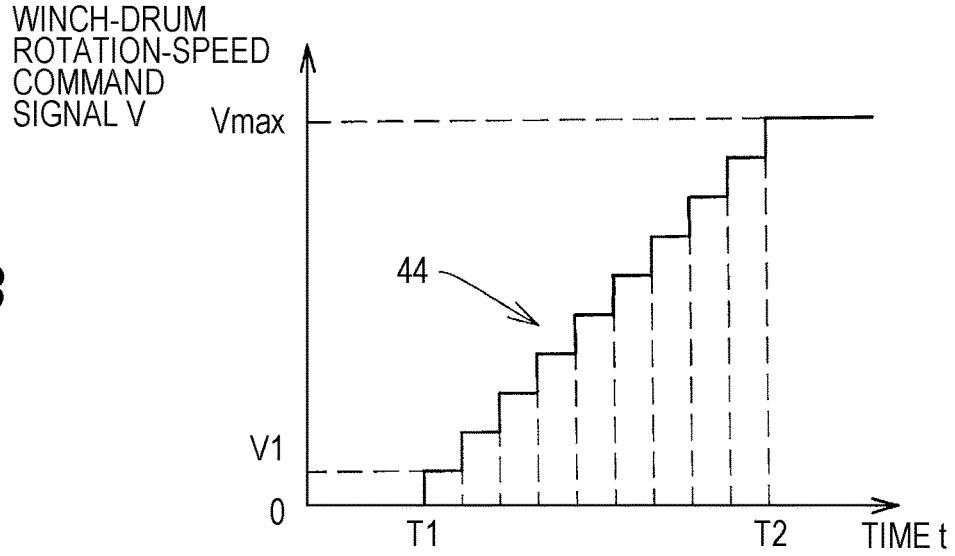
Figure 4C:
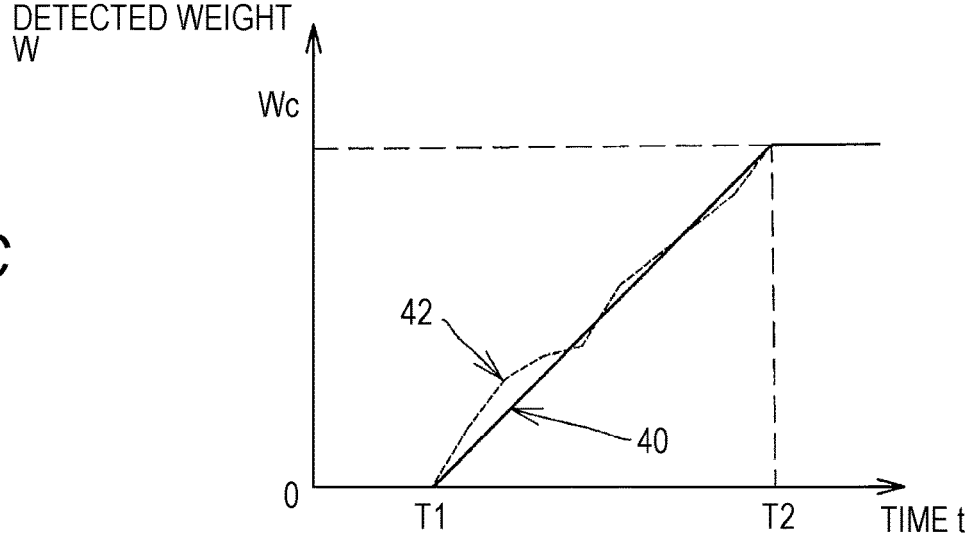

In this case, as illustrated in FIG. 4B, the winch-drum rotation-speed command signal V44 increases stepwise.

The detected weight 42 is exemplified with a broken line of FIG. 4C. The detected weight 42 increases along (namely, following) the weight expressed by the time-weight target characteristic at start-up 40.

Figure 5:
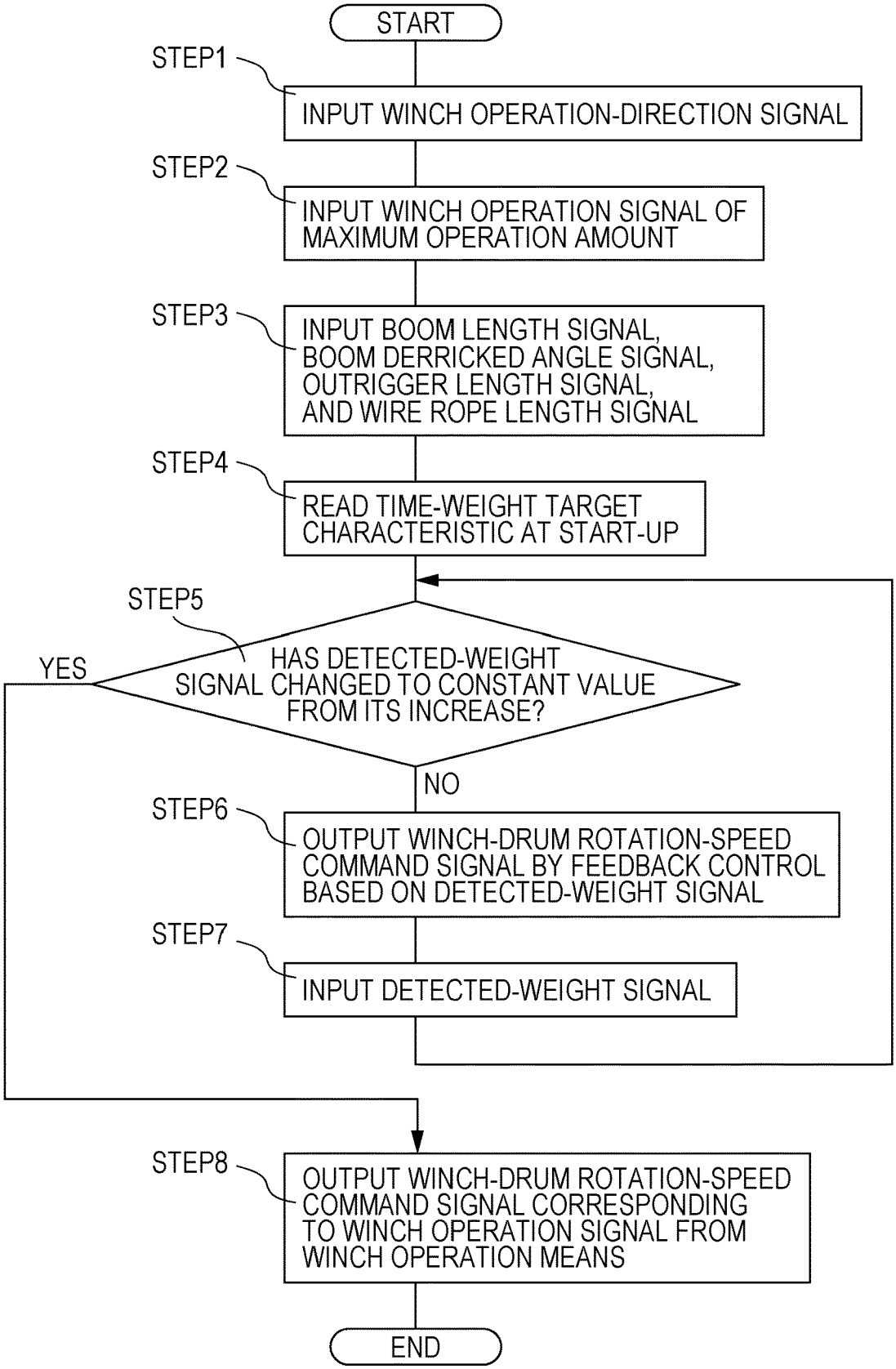
FIG. 5 is a flowchart for describing the control at lifting off the ground of the crane vehicle according to the embodiment.

At STEP 5 illustrated in FIG. 5, in a case where it is determined that the detected-weight signal has changed to the constant value from its increase (YES at STEP 5), it is determined that lifting of the lifting load 16 (refer to FIG. 1) off the ground has been completed (at time T2 of FIG. 4C).

At STEP 8, instead of the feedback control, the winch-drum rotation-speed command signal corresponding to the winch operation signal from the winch operation means 20 (refer to FIG. 2) is output.

As described above, the winch is automatically controlled in accordance with the time-weight target characteristic at start-up, regardless of a full-lever operation made at lifting off the ground. Thus, lifting off the ground can be securely performed with the crane vehicle 1 prevented from being damaged.

In addition, provision of the time-weight target characteristic at start-up including a plurality of characteristics corresponding to the boom length, the boom derricked angle, the outrigger slid length, and the wire rope length, enables automatic lifting off the ground with increase of the rotation speed of the winch drum 15 due to acceleration suitable to the crane state.

Furthermore, because the rotation speed of the winch drum 15 is accelerated from winch start-up until completion of lifting off the ground, the time taken until the completion of lifting off the ground results in an optimum length.

<Operation at Dangling in Midair>

Figure 8:
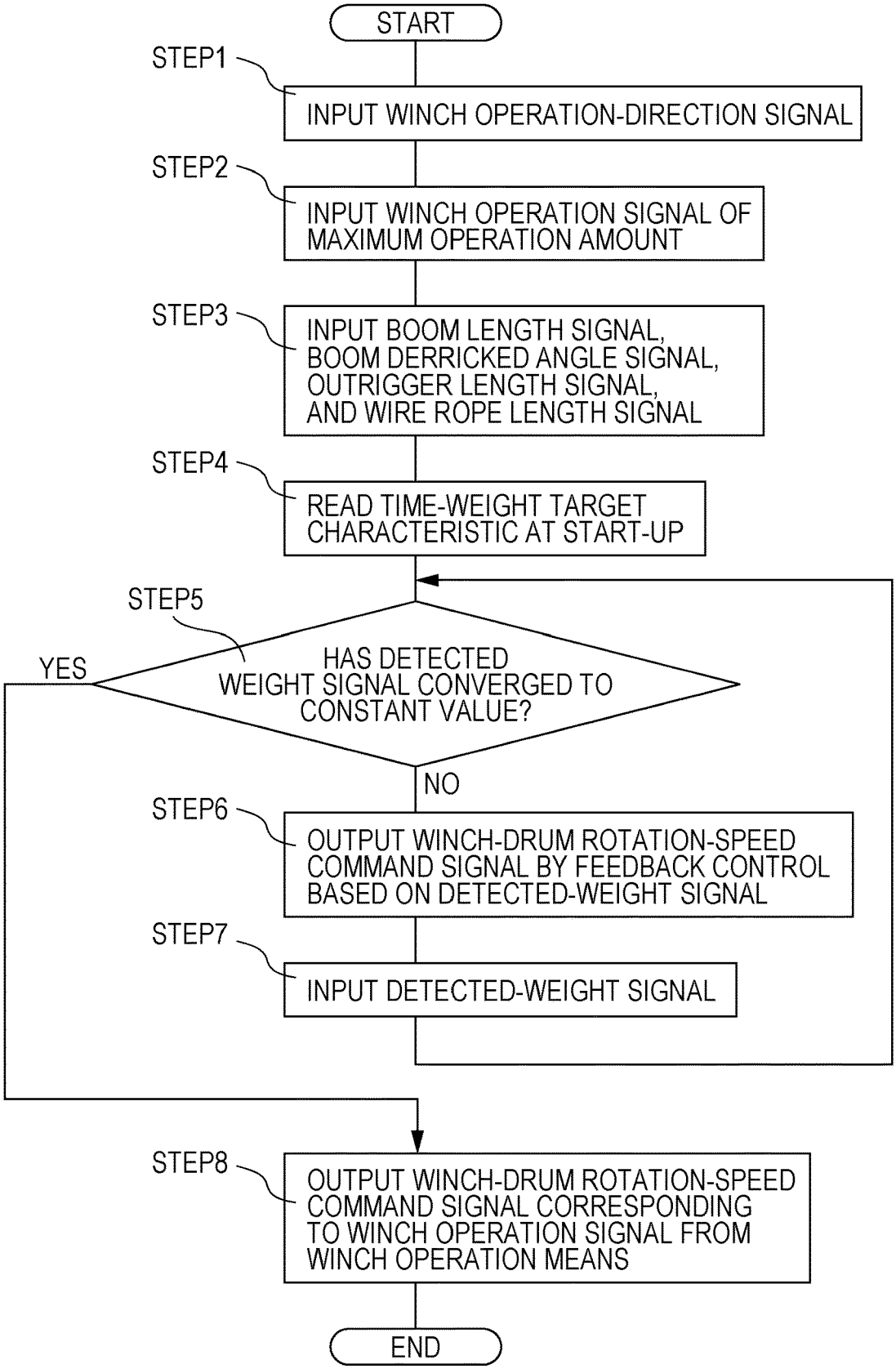
FIG. 8 is a flowchart for describing the control at dangling in midair of the crane vehicle according to the embodiment.

The operation at winding-down start-up of the crane vehicle 1 according to the present embodiment, having a state of dangling in midair, will be described in accordance with a flowchart illustrated in FIG. 8.

Figure 6:
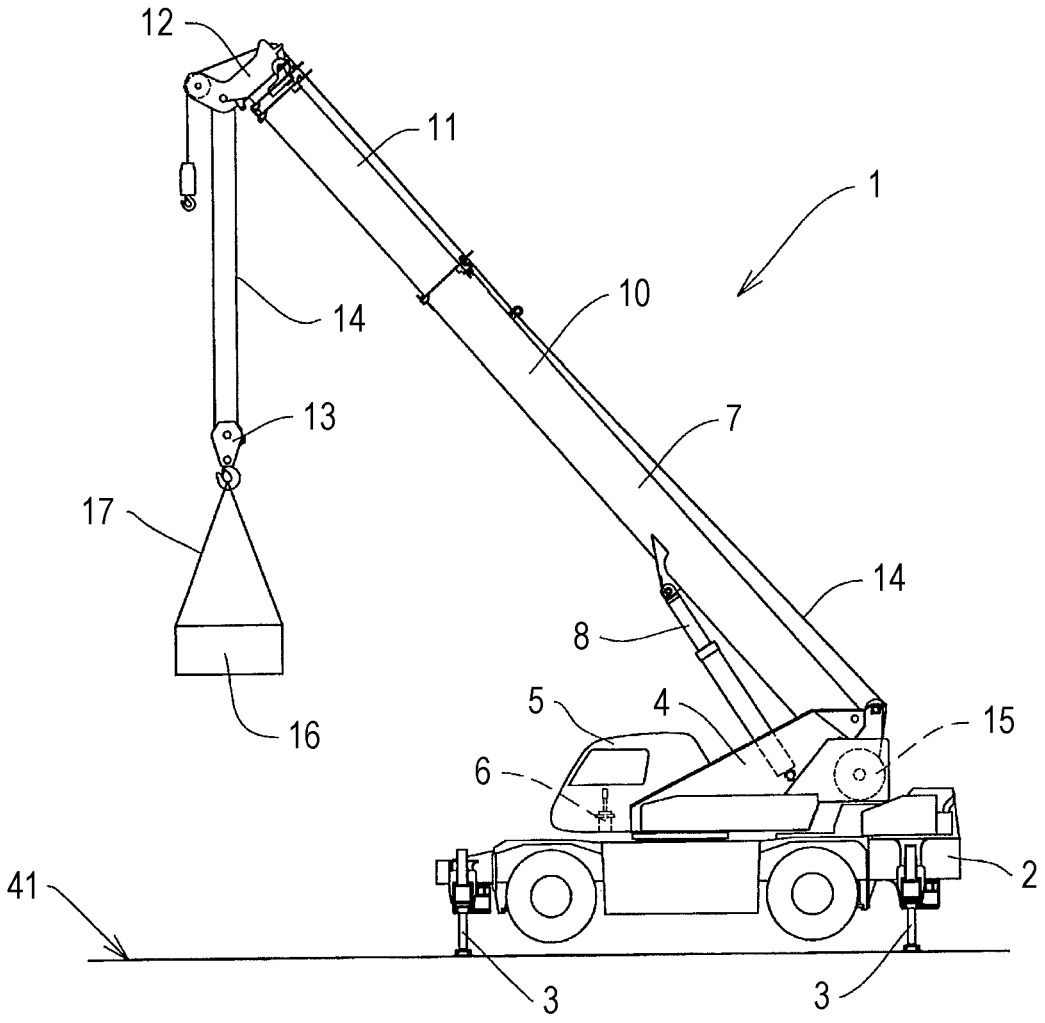
FIG. 6 is a view for describing the crane vehicle with a lifting load dangling in midair.

The crane vehicle 1 is in the state of dangling in midair where the lifting load 16 is hung above the ground 41 (refer to FIG. 6). Here, the operator in the cab 5 makes a full-lever (maximum operation amount) operation to the winch lever 21 of the winch operation means 6 to the winding-down side (refer to FIG. 6).

At STEP 1, the winch operation-direction signal of the winding-down is input.

Figure 7A:
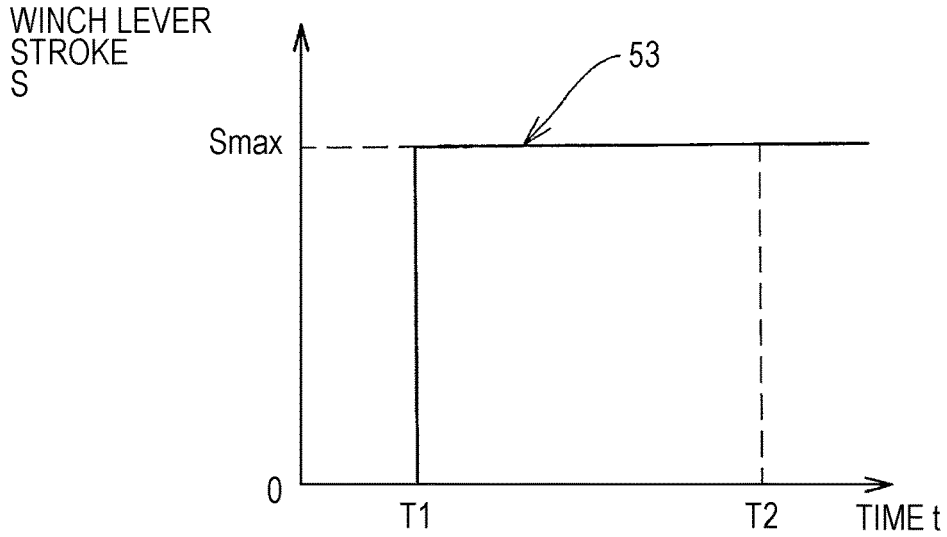
FIGS. 7A, 7B, and 7C are graphs for describing the control at dangling in midair of the crane vehicle according to the embodiment.

At STEP 2, the winch operation signal of the maximum operation amount is input (at time T1 of FIG. 7A).

At STEP 3, the boom length signal, boom derricked angle signal, outrigger length signal, and fed-out wire rope length signal are input.

At STEP 4, the time-weight target characteristic at start-up corresponding to the state of dangling in midair is read. Specifically, at STEP 4, the winch control means 22 reads, from the storage means 37, the time-weight target characteristic at start-up that corresponds to the state of dangling in midair and corresponds to each signal input at STEP 3.

At STEP 5, it is determined whether the detected-weight signal has converged to a constant value. That is, at STEP 5, the winch control means 22 determines whether the fluctuation of the detected value of the weight detection means 25 has converged within a predetermined range.

In a case where it is determined at STEP 5 that the detected-weight signal has not converged to the constant value (NO at STEP 5), at STEP 6, the winch-drum rotation-speed command signal is output by the feedback control based on the detected-weight signal. Then, at STEP 7, the detected-weight signal is input.

Specifically, as illustrated in FIG. 7A, a winch lever stroke S53 is operated to Smax at time T1. Then, the winch-drum rotation-speed command signal V54 illustrated in FIG. 7B is generated and output along the time-weight target characteristic at start-up, indicated with a solid line 50 of FIG. 7C.

The time-weight target characteristic at start-up at dangling in midair is set such that the target weight retains a value identical to the initial value. In actual control, at winch winding-down start-up, the detected-weight changes to the decrease side. At winch winding-up start-up, the detected-weight changes to the increase side. In those cases, the detected-weight value is controlled so as to remain within a predetermined fluctuation band to the target weight.

After that, the feedback control in the configuration of the feedback control system of the winch device described with FIG. 3 is repeated.

Figure 7B:
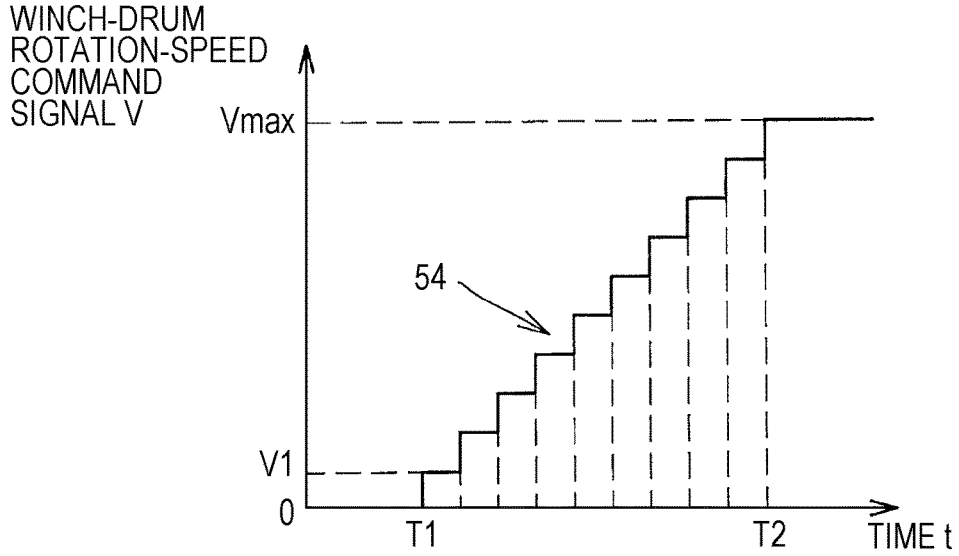

In this case, the winch-drum rotation-speed command signal V54 increases stepwise as illustrated in FIG. 7B.

Figure 7C:
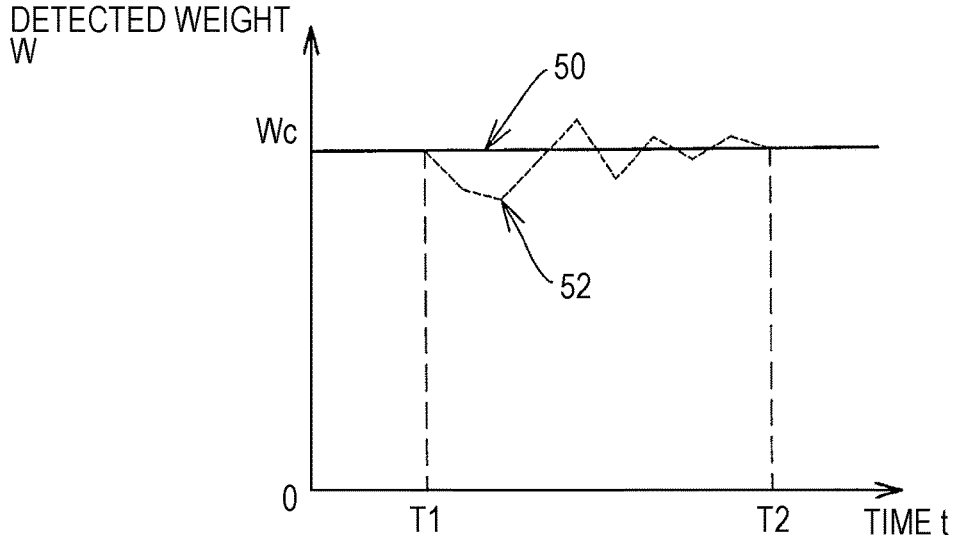

The detected-weight signal 52 is indicated with a broken line of FIG. 7C. The detected-weight signal 52 changes within a predetermined fluctuation band with the weight expressed by the time-weight target characteristic at start-up 50, at the center.

At STEP 5, in a case where it is determined that the detected-weight signal has converged to the constant value (YES at STEP 5), it is determined that the acceleration of winding-down of the lifting load 16 (refer to FIG. 6) has been completed (at time T2 of FIG. 7C).

At STEP 8, instead of the feedback control, the winch-drum rotation-speed command signal corresponding to the winch operation signal from the winch operation means 20 (refer to FIG. 2) is output.

As described above, the winch is automatically controlled in accordance with the time-weight target characteristic at start-up, regardless of a full-lever winding-down operation made to the winch at dangling in midair. Thus, starting-up of winding-down of the lifting load 16 can be securely performed with the wire rope 14 prevented from loosening from and irregularly winding around the winch drum 15.

In addition, provision of the time-weight target characteristic at start-up including a plurality of characteristics each corresponding to at least one parameter of the boom length, the boom derricked angle, the outrigger slid length, and the wire rope length, for a work status, such as the work of lifting off the ground or the work of dangling in midair, enables automatic descent acceleration of the lifting load suitable to the crane work status and the crane state.

The control at winch winding-up start-up with a full-lever operation of the crane vehicle 1 in the state where the lifting load 16 is dangled in midair (refer to FIG. 6) is substantially the same as the control at winding-down start-up. Thus, the detailed description thereof will be omitted.

In this case, because of addition of the counteracting force of force necessary to accelerate the lifting load 16 upward, overcoming inertial force, the weight of the lifting load 16 that the weight detection means 25 detects, increases apparently. The winch control means 22 performs automatic control such that the apparent weight increase remains within a predetermined range.

<Notes>

As Reference Example 1 of the crane vehicle 1 according to the present invention, a crane vehicle includes: a winch operation means that detects the operation direction and the operation amount of a winch lever; a weight detection means that detects the weight of a lifting load; a winch control means that receives a winch operation signal and a detected-weight signal and generates a winch-drum rotation-direction command signal and a winch-drum rotation-speed command signal; and a winch means that receives a command signal from the winch control means and drives a winch drum at the commanded speed in the commanded direction. Such a crane vehicle includes a storage means that stores a time-weight target characteristic at start-up. When receiving the winch operation signal of the maximum operation amount at winch start-up, the winch control means reads the time-weight target characteristic at start-up, from the storage means, and generates the winch-drum rotation-speed command signal by feedback control based on the detected-weight signal such that the detected-weight signal changes along the target characteristic.

As Reference Example 2 of the crane vehicle, according to Reference Example 1, the storage means stores the time-weight target characteristic at start-up at lifting off the ground, set such that target weight increases from zero at a predetermined change rate. When receiving the winch operation signal of the winding-up direction and the detected-weight signal of a weight of 0, at winch start-up, the winch control means reads the time-weight target characteristic at start-up at lifting off the ground, from the storage means. When the detected-weight signal changes to a constant value after increasing from zero after the winch start-up, the winch control means determines that lifting of the lifting load off the ground has been completed. Then, the winch control means finishes generation of the winch-drum rotation-speed command signal by the feedback control, and generates the winch-drum rotation-speed command signal corresponding to only the winch operation signal from the winch operation means.

As Reference Example 3 of the crane vehicle, according to Reference Example 1, the storage means stores the time-weight target characteristic at start-up at dangling in midair, set such that the target weight remains within a predetermined fluctuation band to the initial value. When receiving the winch operation signal and the detected-weight signal that is not a weight of 0, at winch start-up, the winch control means reads the time-weight target characteristic at start-up at dangling in midair, from the storage means. When the detected-weight signal converges to the weight value at start-up after the winch start-up, the winch control means determines that acceleration of the lifting load has been completed. Then, the winch control means finishes generation of the winch-drum rotation-speed command signal by the feedback control, and generates the winch-drum rotation-speed command signal corresponding to only the winch operation signal from the winch operation means.

As Reference Example 4 of the crane vehicle, according to Reference Example 1, the crane vehicle further includes: a boom length detection means that detects the boom length of a telescopic boom; a boom derricked angle detection means that detects the derricked angle of the telescopic boom; an outrigger slid length detection means that detects the outrigger sild length of an outrigger; and a wire rope length detection means that detects the length of a wire rope fed out from the winch. The winch control means receives a boom length signal, a boom derricked angle signal, an outrigger slid length signal, and a wire rope length signal. The storage means stores the time-weight target characteristic at start-up with boom length, boom derricked angle, outrigger slid length, and wire rope length as parameters. Furthermore, the winch control means reads the time-weight target characteristic at start-up corresponding to the boom length, boom derricked angle, outrigger slid length, and wire rope length at winch start-up, from the storage means.

This application is based upon and claims the benefit of priority from Japanese Patent Application No. 2017-138865, filed on Jul. 18, 2017, the entire contents of which are incorporated herein by reference.

REFERENCE SIGNS LIST

1 crane vehicle
6 winch operation means
7 telescopic boom
14 wire rope
15 winch drum
20 winch operation means
21 winch lever
22 winch control means
23 boom length detection means
24 boom derricked angle detection means
25 weight detection means
26 outrigger length detection means
27 wire rope length detection means
30 winch means
37 storage means

The invention claimed is:

1. A crane vehicle comprising:

an operation unit;

a winch device configured to operate at a speed corresponding to an operation amount of the operation unit, to wind up and feed out a wire rope to which a hook is fixed;

a weight detection unit configured to detect a weight of a lifting load;

a storage unit configured to store a time-weight target characteristic indicating a target in temporal change of a detected value at the weight detection unit for a maximum operation amount input from the operation unit; and a control unit configured to perform feedback control of an operation speed of the winch device such that the detected value follows the time-weight target characteristic in a case where the maximum operation amount is input from the operation unit, the control unit being configured to set the operation speed of the winch device at the speed corresponding to the operation amount of the operation unit, in a case where fluctuation of the detected value has converged in a predetermined range.

2. The crane vehicle according to claim 1, wherein the storage unit stores, for a work status, the time-weight target characteristic corresponding to at least one parameter of boom length, boom derricked angle, outrigger slid length, and wire rope length.

3. The crane vehicle according to claim 2, wherein the storage unit stores the time-weight target characteristic for the work status that is work of lifting off a ground, and the time-weight target characteristic at the work of lifting off a ground is set so as to increase from an initial value of 0 at a predetermined change rate with time.

4. The crane vehicle according to claim 2, wherein the storage unit stores the time-weight target characteristic for the work status that is work of dangling in midair, and the time-weight target characteristic at the work of dangling in midair has a constant value.

* * * * *